United States Patent [19]

Brouse et al.

[11] Patent Number: 4,587,791

[45] Date of Patent: May 13, 1986

[54] EDGE PROTECTOR POSITIONING APPARATUS

[75] Inventors: S. Bernard Brouse, Orland Park; John Wiedel, Chicago, both of Ill.

[73] Assignee: United States Steel Corporation, Pittsburgh, Pa.

[21] Appl. No.: 685,526

[22] Filed: Dec. 24, 1984

[51] Int. Cl.[4] ..... B65B 13/06

[52] U.S. Cl. ..... 53/128; 53/582; 53/589

[58] Field of Search ..... 53/128, 582, 589; 221/239, 294; 271/137, 138; 414/131

[56] References Cited

U.S. PATENT DOCUMENTS

| | | | |
|---|---|---|---|
| 646,124 | 3/1900 | Kraft . | |
| 2,809,032 | 10/1957 | Krag | 271/137 X |
| 2,932,428 | 4/1960 | McGranahan | 221/239 X |
| 3,100,583 | 8/1963 | Erickson | 221/239 X |
| 3,241,287 | 3/1966 | Chundelak | 53/582 X |
| 3,271,925 | 9/1966 | Aubery | 53/128 |
| 3,378,987 | 4/1963 | Lems | 53/124 |
| 3,585,780 | 6/1971 | Elmore | 53/124 |

FOREIGN PATENT DOCUMENTS

| | | | |
|---|---|---|---|
| 1156015 | 7/1956 | France | 271/137 |
| 1561084 | 6/1967 | France | 271/138 |
| 669155 | 6/1961 | Italy | 414/131 |

*Primary Examiner*—John Sipos
*Attorney, Agent, or Firm*—William F. Riesmeyer, III

[57] ABSTRACT

Apparatus for positioning an edge protector to the edge of a package to be looped with strapping is provided. The apparatus includes a guide rail extending generally normal to the exposed package edge and an edge protector positioning apparatus mounted on the rail. The edge protector positioning apparatus has an edge protector application station adjacent the edge to be protected and is provided with an angularly oriented magazine which stores a stack of nested edge protectors each with its concave face foremost. Edge protectors are delivered to the application station from the magazine by means of a fluid motor operated pushing means which acts normal to the magazine to individually remove each edge protector therefrom. From the pushing means depend extended fingers having an edge protector support surface. A spring-biased separator assures individual edge protector application and spring-biased clamping means cooperate with the fingers of the pushing means to provide accurate edge protector placement on the package. Upon retraction of the pushing means and its extended fingers, the clamping retains the edge protector on the package during strapping. Following strapping, the apparatus is retracted from proximity with the package thereby releasing the edge protector.

14 Claims, 8 Drawing Figures

EDGE PROTECTOR POSITIONING APPARATUS

DESCRIPTION OF THE INVENTION
BACKGROUND

The present invention relates to strapping machines designed to apply a bundling strap to a large package and, in particular, to an apparatus for applying edge protectors to the edges of the package prior to the application of strapping thereabout.

In order to facilitate the handling of large objects or a plurality of objects, it is often desirable to cause a strap to be placed about the object or to create a package by strapping together a plurality of objects. As used herein "package" is intended to refer to either a single object or a multiplicity of objects either previously joined or to be joined by strapping. In addition, "strap" or "strapping" applies equally to metal or non-metal strap of generally rectangular cross section or oval-shaped or circular wire or any other material suitable for binding a package.

Typically, such straps are applied under a considerable degree of tension and, often, the package is of a nature which renders it advantageous to compress the package prior to applying strapping thereto. Obviously, if a package is compressed and a strap is applied under tension, when the compressive force is released, additional tension will be created in the strap.

It must be appreciated that when such a tension is present in the encircling strapping, the edge or corner areas of the package are vulnerable to damage by the strapping. Such damage may occur in various ways. For example, the edge areas may be damaged by impressions caused by the strapping. Also, if a metal strap is utilized, it will be subject to corrosion which would likely stain or otherwise disfigure the package. It is notable that in some applications, especially in the lumber industry, if any of the package of lumber is damaged, the price receivable for the entire package may be substantially decreased. As such, it is desirable to place edge protectors on the edges of the package which will be in contact with the strapping prior to the application thereof.

Such edge protectors may consist of metal, plastic, fibrous or other material capable of distributing the localized force caused by the strapping on the edge of the package. The edge protectors typically utilized have a concave face configured to conform to the edge to be protected. Recently, in certain applications, it has become particularly advantageous to utilize fibrous or hard cardboard edge protectors having two legs and an included angle of approximately ninety degrees (90°). One advantage of such an edge protector is that that type of edge protector is usually lowest in cost per unit. Also, such protectors do not themselves tend to damage by impression or otherwise the package edge areas as may occur with metal or plastic edge protectors. Moreover, cardboard edge protectors do not corrode and thereby stain the package surface.

Previously, edge protectors were placed on the package corners by hand. Obviously, such a practice was labor intensive, and thus costly, slow and dangerous. In addition, prior mechanized edge protector applicators have proven expensive and readily susceptible to jamming or misplacement, especially with respect to fibrous edge protectors. Also, regarding fibrous corner protectors, as they frequently expand in thickness up to 80% and the included angle often varies, prior means of application have proven inadequate to accommodate such a change in thickness. Moreover, as a great range of angular variations is present in the fibrous edge protectors, an additional problem is presented.

The subject invention is directed toward an improved apparatus for edge protector application which overcomes, among others, the above-described problems and provides an effective, efficient device for accurately positioning edge protectors on the edges of a package to which strapping is to be applied.

SUMMARY OF THE INVENTION

In accordance with the present invention, there is provided apparatus for applying an edge protector to an edge of a package to be secured with strapping by means of a strapping machine which may have a reciprocating compressing platen. The herein provided apparatus includes a horizontal rail affixed to the compressing platen and a fluid motor or reciprocable hydraulic cylinder for moving the edge protector positioning apparatus therealong. The edge protector positioning apparatus itself is provided with delivery and application stations. The delivery station is in operative communication with a magazine which stores a series of nested edge protectors disposed concave face foremost. Edge protectors are individually removed from the magazine and moved from the delivery station to the application station by means of a fluid motor-powered edge protector pushing means which is driven along an edge protector guide track normal to the magazine. A spring-biased separator gate is provided to ensure individual edge protector removal and to prevent jamming of the edge protector delivery system. The leading end of the edge protector pushing means includes extended fingers which include edge protector support surfaces. A spring-biased clamping means cooperates with the pushing means and the edge protector support surfaces to provide accurate edge protector placement on the package. Upon retraction of the edge protector pushing means and its extended fingers, the clamping means retains the edge protector on the package during strapping. Following strapping, the entire apparatus is retracted from the package area and the edge protector is released.

Accordingly, the present invention provides solutions to the aforementioned problems associated with the strapping of packages. As this invention provides an efficient means of placing edge protectors on the edge of a package to be strapped, the problems of improper edge protector placement or a lack of edge protector placement prior to strapping are avoided. In addition, as edge protectors are positively positioned during strapping, the entire strapping process need not be halted to correct the placement of an individual edge protector.

Those and other details, objects and advantages of the invention will become apparent as the following description of the present preferred embodiment proceeds.

BRIEF DESCRIPTION OF THE DRAWINGS

In the accompanying drawings, I have shown a present preferred embodiment of the invention wherein.

DETAILED DESCRIPTION OF THE DRAWINGS

Figure 1:
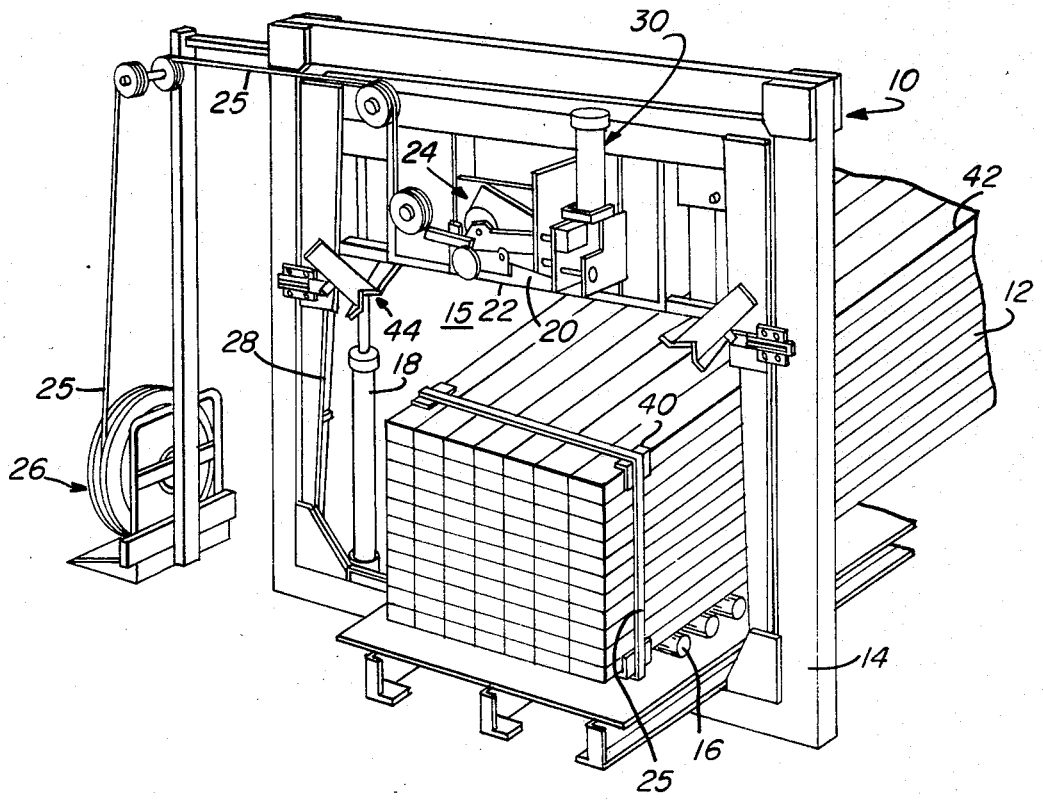
FIG. 1 is a front perspective view of a strapping machine which includes the herein-provided edge protector positioning apparatus.
Figure 2A:
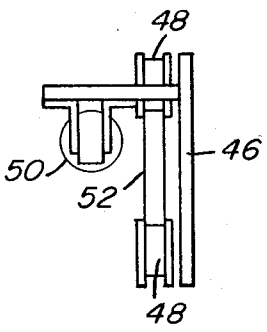
FIG. 2*a* is a detailed end view of the support structure provided for the edge protector positioning apparatus.
Figure 2:
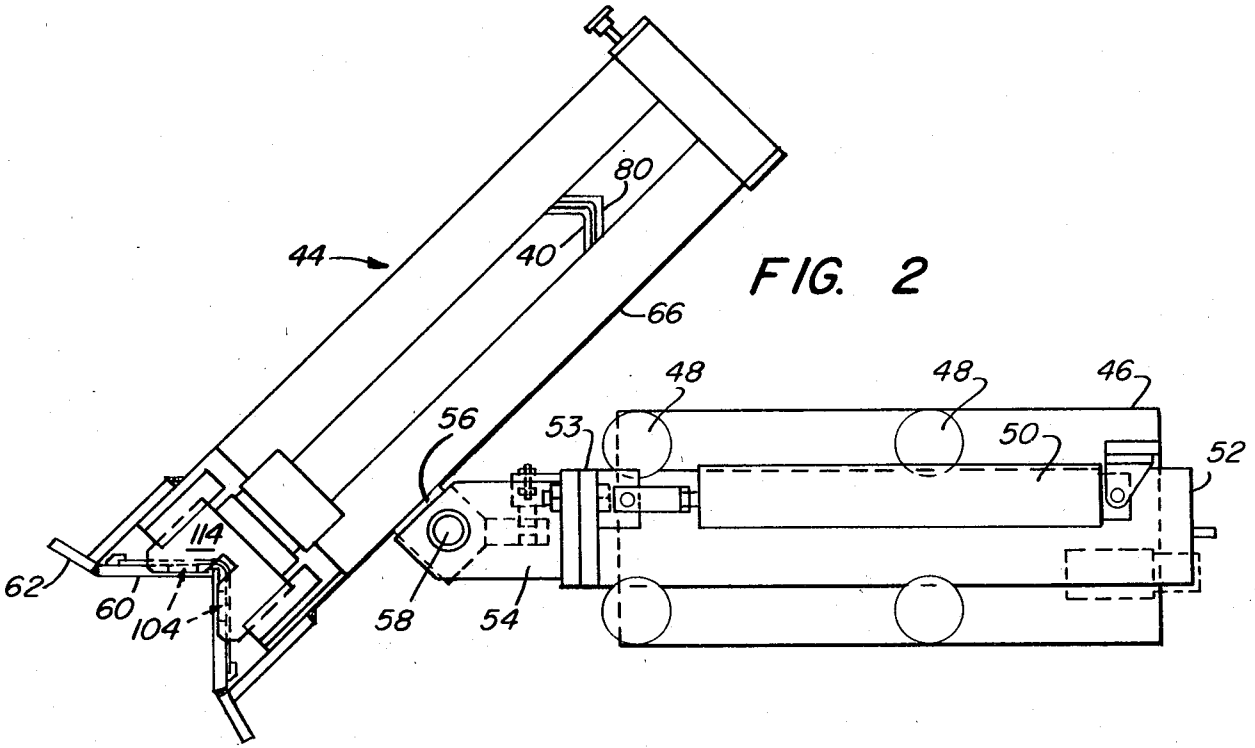
FIG. 2 is a front elevational view of the edge protector positioning apparatus and accompanying support structure.

Referring now to the drawings wherein the showings are for purposes of illustrating the present preferred embodiment of the invention only and not for limiting same, the figures show an apparatus, generally designated as 10 for applying a strap around a package 12 which may consist of a singular article or a plurality of any articles to be bound, which articles may consist of lumber such as elongated boards.

As best shown in FIG. 1, strapping apparatus 10 includes a gantry frame 14 which defines a station 15 for applying strapping to package 12. A conveyor 16 is provided to pass transversely through gantry frame 14 to carry package 12 through the strapping station 15 in order that straps may be placed at spaced locations along the length of package 12. Dual vertical hydraulic operators 18 are affixed opposite lateral sides of frame 14 and carry horizontal pressure platen 20 for causing reciprocation movement thereof toward and away from conveyor 16. The pressure platen 20 is a generally rectangular structure which includes pressing surface 22. Affixed to pressure platen 20 above pressing surface 22 is a strapping feed and tension unit, generally 24, which supplies strapping 25 from an appropriate source 26. Unit 24 feeds the strapping 25 around strap-receiving channel 28 which is generally U-shaped in cross section and surrounds the strapping station 15. Following compression of the package 12 and application of edge protectors, as described more fully herein, unit 24 tensions strapping 25 about package 12 and strapping binding unit 30, which is provided on pressure platen 20 in proximity to feed and tension unit 24, secures the strapping 25 to itself by means of binding clips. It will be apparent to those skilled in the art that in the event an alternative form of strapping 25, e.g. round wire strapping, is used, unit 30 may be replaced with a knotter unit to secure the strapping 25.

In order that edge protectors 40 may be positioned on the edges 42 of the package 12, there is provided edge protector positioning apparatus generally designated 44. To position an edge protector 40 at each edge 42 which is to be in contact with strapping 26, an edge protector positioning apparatus 44 may be provided at each such edge 42 of the package 12. As such, each edge protector positioning apparatus 44 is supported by means of individual base plates 46. In order that an edge protector 40 may be placed on each of the upper edges 42, an edge protector positioning apparatus 44 may be located in proximity to such edge 42 by means of supporting base plate 46 on each lateral side of pressure platen 20 adjacent the pressing surface 22. To apply edge protectors 40 to the lower edges 42 of package 12, an edge protector positioning apparatus 44 may be supported by a base plate 46 which is affixed to the lower region of frame 14 on the opposite sides thereof adjacent such lower edges 42. In an effort to more clearly describe the details of the remaining structure, the following description of edge protector positioning apparatus 44 will be directed to an apparatus 44 disposed to position an edge protector 40 on an upper edge 42 of package 12. However, it is to be understood that the description of details of apparatus 44 applies equally to such apparatus when utilized adjacent a lower edge 42 except that apparatus 44 will be provided to be inverted.

With reference to an edge protector positioning apparatus 44 for an upper edge 42, base plate 46 is provided to be affixed to the front vertical surface of pressure platen 20 adjacent pressing surface 22. Upper and lower sets of twin horizontal rollers 48 are attached to base plate 46. A reciprocable fluid motor 50, such as an air cylinder, is affixed horizontally to the end of base plate 46 remote from the strapping station 15. Guide rail 52 is movably supported between rollers 48 and is affixed at its leading end to the movable piston of reciprocable fluid motor 50. The extension of edge protector positioning apparatus 44 is accomplished by means of rail 52 being slidably supported on rollers 48. Bracket 53 is affixed to the leading end of rail 52 and to the end of the piston of cylinder 50. Intermediate bracket 54 is adjustably connected to bracket 53 by means of the clearance provided by loose fitting-bolt 55. Edge protector positioning apparatus 44 is supported by bracket 56 which is, in turn, adjustably mounted on bracket 54 by means of gimbal mounting 58. As it is preferable that edge protector positioning apparatus 44 be disposed angularly with respect to guide rail 52, particularly at an angle of approximately forty-five degrees (45°), brackets 53, 54 and 56 cooperate to so dispose edge protector positioning apparatus 44 and to assure accurate placement of edge protector positioning apparatus 44 on the edge 42. In operation, the travel of edge protector positioning apparatus 44 along base 46 toward package 12 is limited by the package itself which causes the stalling out of cylinder 50 and the accurate positioning edge protector positioning apparatus 44 on package 12.

The structure of the edge protector positioning apparatus 44 itself includes a lower frame member 60 which consists of an elongated right angular member, each leg thereof having extended bars 62. The combination of lower frame 60 and extended bars 62 creates a cam surface which is provided to engage edge 42 in order that edge protector positioning apparatus 44 may accurately position edge protector 40 thereon. Further, gimbal mounting 58 and bolt 55 are configured to allow sufficient movement of apparatus 44 so that it may accurately be adjusted to the orientation of edge 42. Dual plates 64 are affixed intermediate frame 60 and bars 62 and extend along a portion of the length thereof. Extending from plates 64 is a "U"-shaped supply hopper or magazine 66. An encircling member 68 is provided to join the respective elements of magazine 66 at the uppermost ends thereof. Face plate 70 is affixed to the side of magazine 66 from which edge protectors 40 are to be removed. As such, magazine 66 and its constituent members form a storage area for a series of angled leg-type edge protectors 40 to be stacked therein in nested fashion with the concave face of one edge protector 40 engaging the rear surface of the previous edge protector 40. It will be understood that other types of edge protectors 40 may be applied by apparatus 44 by incorporating alterations within the skill of one in the art. Provided within magazine 66 is an angled supply bracket 80 having a face configured to engage the rear surface of the last edge protector 40 and to cooperate with a spring-biasing means (not shown) to urge the edge protectors 40 toward a delivery station 82 at the end of magazine 66 nearest lower frame 60.

Figure 3:
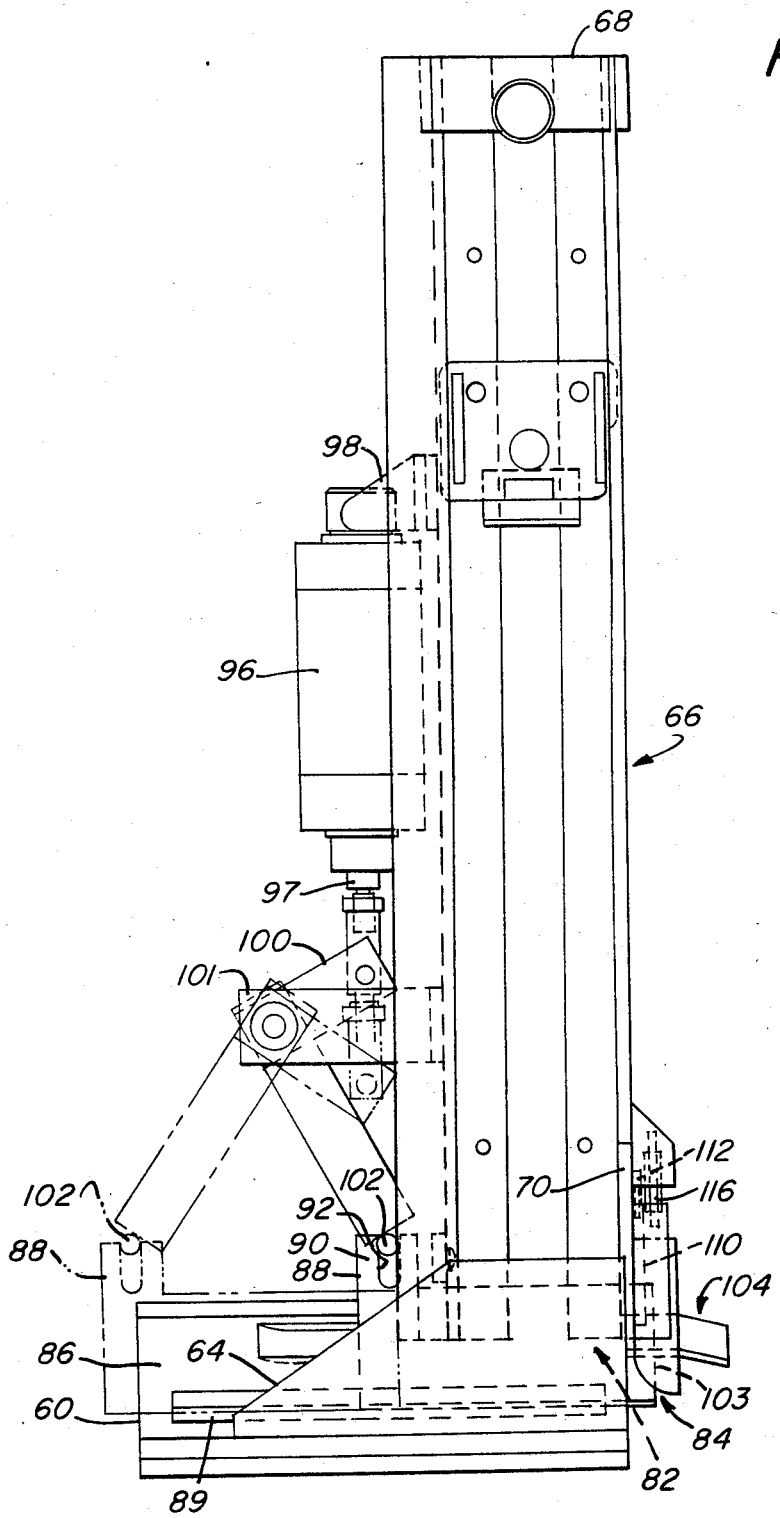
FIG. 3 is a plan view of the edge protector positioning apparatus.
Figure 4:
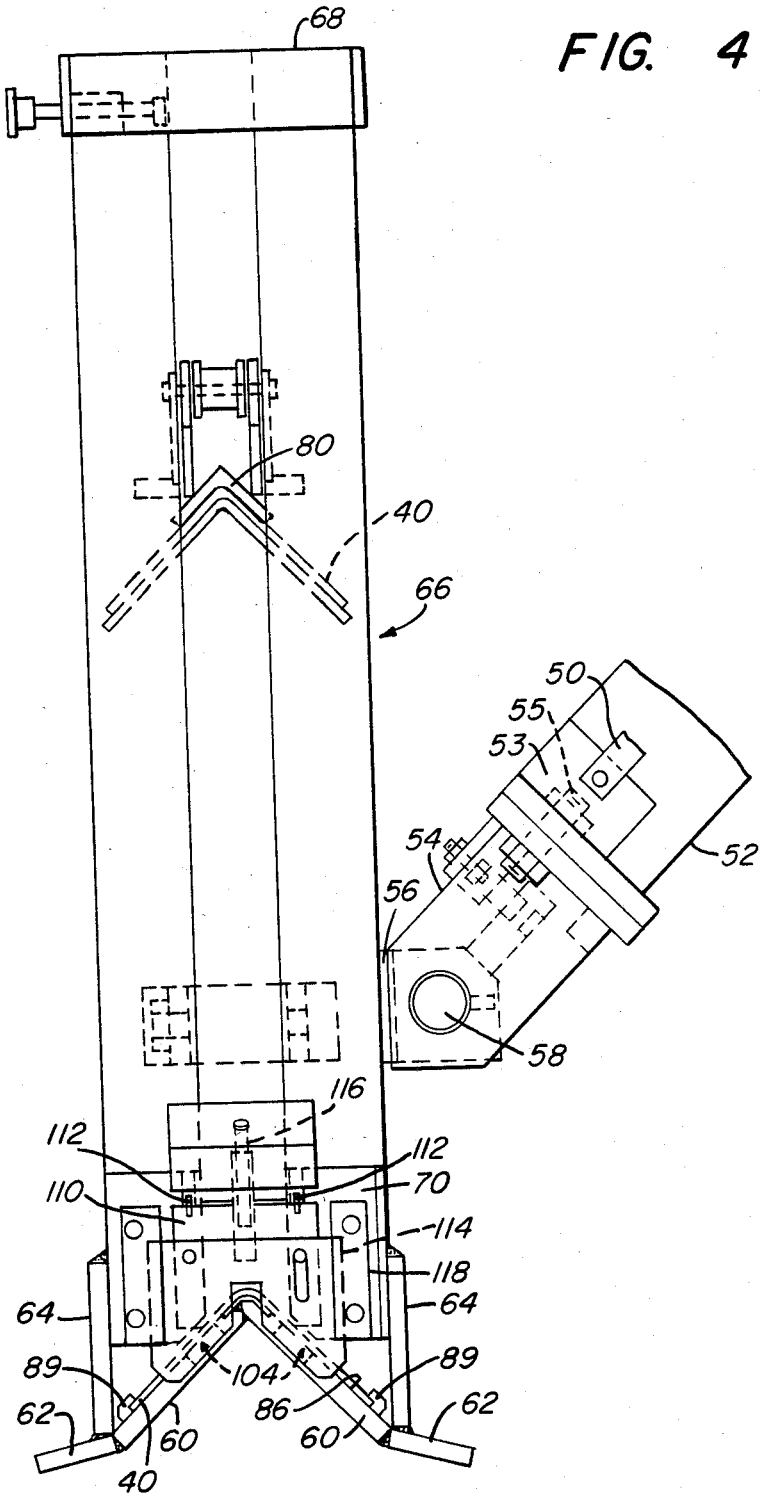
FIG. 4 is a side elevational view of the edge protector positioning apparatus.

In order to position an edge protector 40 on edge 42, an application station, generally designated as 84, is provided at the leading end of edge protector positioning apparatus 44. The upper surface of lower frame 60 provides an angled track 86 along which edge protectors 40 may be directed with their concave face engaging said track 86 from delivery station 82 to application station 84. The mechanism for driving edge protectors 40 between delivery station 82 and application station 84 includes a pusher ram 88 which consists of an elongated L-shaped member, the concave face of which also conforms to track 86. Gibs 89 are provided to retain pusher ram 88 on track 86 and, as will become apparent as this description continues, prevent an edge protector 40 from being jammed under pusher ram 88. Extending vertically from each angled side of pusher ram 88 remote from application station 84 are driver brackets 90 which each include a slot 92 adapted to be driven by the following means. A fluid motor 96 which may consist of a reciprocable hydraulic cylinder is affixed at one end thereof to the rear surface of magazine 66 by means of bracket 98. The reciprocating piston 97 of fluid motor 96 is rotatably connected to one leg of a bell and crank mechanism 100 which is pivotally connected to bracket 101 which, in turn, is also affixed to magazine 66. A driving pin 102 is affixed to the free end of bell and crank 100 and is configured to operatively engage slot 92 by means of its driver brackets 90. Accordingly, when the reciprocating piston 97 is withdrawn from its extended position to its retracted position, bell and crank 100 is rotated counterclockwise as viewed in FIG. 3 thereby moving driving pin 102 in an arc generally in the direction of application station 84 which, in turn, causes pusher ram 88 to be so driven along track 86. Upon initiation of movement toward application station 84, the pushing surface 103 of pusher ram 88 will immediately engage the edge protector 40 then disposed within delivery station 82 and cause such edge protector 40 to be pushed toward application station 84. Correspondingly, when the piston 97 of fluid motor 96 is extended from its retracted position, bell and crank 100 is rotated clockwise, as viewed in FIG. 3, the driver pin 102 is generally moved away from application station 84 thereby moving pusher ram 88 from application station 84, past delivery station 82 and into position to receive the next edge protector 40 to be applied.

In the preferred embodiment of this invention, elongated fingers 104 are provided to extend from pusher ram 88 adjacent and beneath pusher surface 103. Such pusher fingers 104 include a generally flat surface 106 in closest proximity to pusher surface 103 and an inclined surface 108 extending from flat surface 104 and inclining away from pusher surface 103 and toward package 12 when apparatus 44 is in its operating position.

To assure that pusher ram 88 only drives one edge protector 40 to application station 84 and to accommodate variations in thickness of edge protectors 40, a separator gate 110 having a tapered end region 111 is provided outboard of face plate 70 and is biased toward application station 84 by means of springs 112. As such, tapered end region 111 of separator gate 110 engages edge protector 40 when driven by pusher ram 88 and is caused to ride thereon, thereby assuring that only one edge protector 40 is delivered to the application station 84.

Figure 5A:
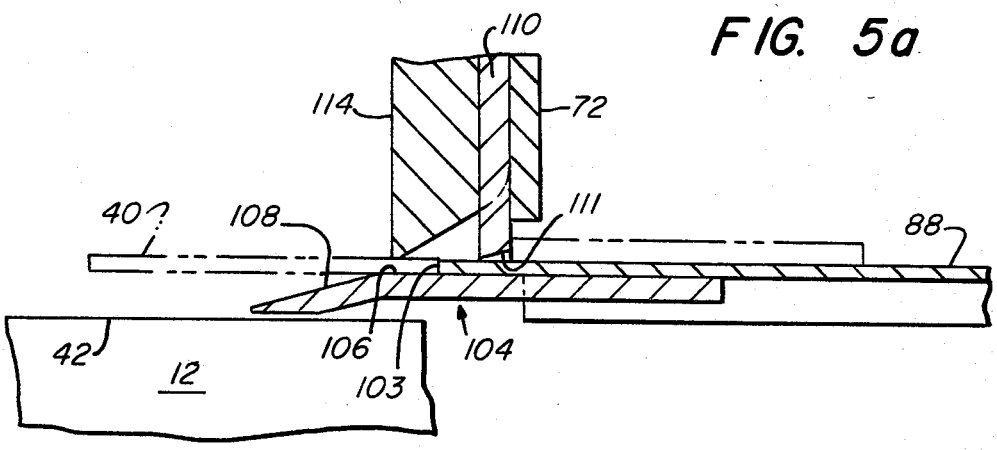
FIGS. 5*a*, 5*b* and 5*c* are partial sectional views of the edge protector positioning apparatus during the sequence of application of an edge protector.
Figure 5B:
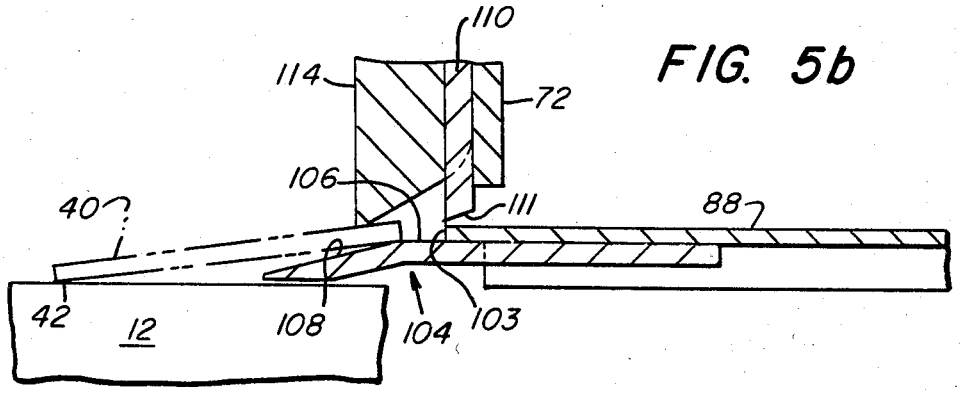
Figure 5C:
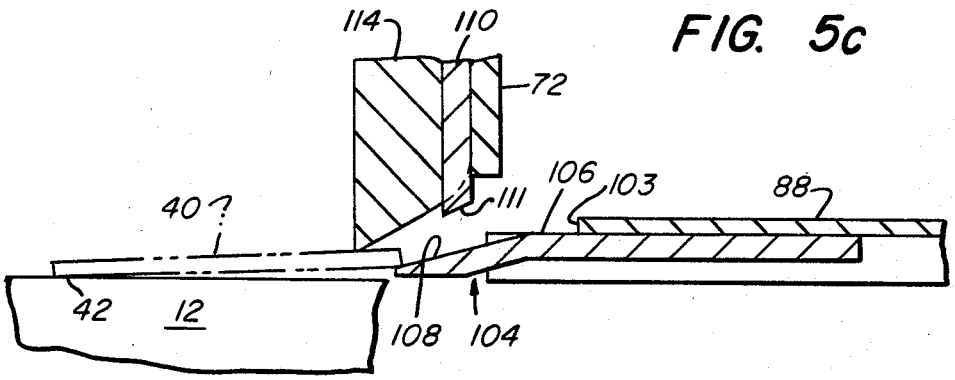

A clamping means which includes clamping plate 114 having a clamping surface conforming to the rear surface of edge protector 40 is provided adjacent and outbound of separator plate 110. Clamping plate 114 is biased toward application station 84 by means of spring 116. In addition, gibs 118 are provided to assure linear motion of clamping plate 114. As is shown best in FIGS. 5, *a, b,* and *c,* clamping plate 114 cooperates with pusher fingers 104 to accurately and positively position edge protector 40 on package 12. As the pusher surface 103 of pusher ram 88 drives an edge protector toward application station 84, the separator gate 110 is caused to ride upon edge protector 40 and prevent delivery of more than one edge protector 40. Then, the inclined surface of clamping plate 114 is engaged by edge protector 40 thereby causing clamping plate 114 to be displaced vertially and ride on edge protector 40 while biasing edge protector 40 against the flat surface 106 of pusher finger 104. Following extension of pusher ram 88, edge protector 40 is positioned above and in close proximity to package 12. As pusher ram 88 and pusher finger 104 are withdrawn from application station 84, clamping plate 114 begins to bias edge protector 40 against inclined surface 108 of pusher finger 104. As such, the leading end of edge protector 40 is lowered onto package 12. As pusher finger 104 is completely withdrawn, inclined surface 108 leaves edge protector 40 and edge protector 40 is biased against package 12 by clamping gate 114. It is at this point that strap 26 is applied to package 12 and edge protector 40.

Following the application of strap 26 to package 12 around edge protector 40, the entire assembly 44 is withdrawn by means of rail 52 moving along rollers 48 to await the next area of edge 42 to receive an edge protector 40.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. Positioning apparatus for positioning an edge protector at an edge of a package to be looped with a strapping, said edge protector having a package contact face comprising:

(a) a feeder having a delivery station for systematically receiving edge protectors to be dispensed;

(b) an application station immediately adjacent said delivery station for receiving individual edge protectors from said delivery station;

(c) an operator for selectively driving an edge protector from said delivery station to said application station, said operator including a pushing surface normal to the longitudinal axis of the edge protector and at least one forwardly extending finger having an edge protector support surface and means to reciprocate said operator between said delivery and application stations;

(d) clamping means at said application station for applying a substantially normal force to said edge protector for retaining said edge protector on said support surface and in spaced conforming relation to said edge while said operator is disposed within said application station and upon retraction of said operator for tilting said edge protector onto said edge and retaining said edge protector in conforming relation to said edge when said operator is removed from said application station.

2. Apparatus of claim 1 in which said edge protector support surface comprises:

(a) a leading surface, said leading surface being inclined toward said package; and (b) a flat surface parallel to said edge and disposed between said pusher surface and said leading surface.

3. Apparatus of claim 2 further comprising a biased separator gate between said clamping means and said delivery station, said separator gate being disposed parallel to the plane of and in close proximity with said pushing surface when said operator is disposed within said application station.

4. Apparatus of claim 3 in which said feeder comprises a magazine in communication with said delivery station, said magazine being provided to hold a nested stack of edge protectors biased to move contact face foremost toward said delivery station.

5. Apparatus of claim 4 in which said operator further comprises:

(a) a reciprocable slide, one end of which terminates in said pushing surface; and (b) means for reciprocating said slide which comprises:

(i) a first reciprocating drive means;

(ii) a bell and crank lever one end of which is operatively connected to said drive means, the other end of said bell and crank lever terminating in a driver pin;

(iii) a driver slot affixed to and extending normal to said slide, said driver slot being configured to accept said driver pin therein and to move said slide in response to the motion of said driver pin.

6. Apparatus of claim 5 further comprising a track means extending between said delivery station and said application station, said track means being generally conformed to the shape of said contact surface of said edge protector.

7. Apparatus of claim 6 further comprising means for moving said edge protector positioning apparatus tranversely to said package between a first position remote from and normal to said edge of said package and a second position adjacent said edge of said package.

8. Apparatus of claim 7 in which said means for moving said edge protector positioning apparatus comprises:

(a) a support plate;

(b) a support rail;

(c) wheels affixed to said support plate, said wheels being adapted to movably supportably receive said support rail;

(d) a second reciprocating drive means affixed at one end to said support plate; and, (e) bracket means for affixing the other end of said second reciprocating drive means to said edge protector positioning apparatus and to said support rail.

9. Apparatus of claim 8 in which said means for affixing said other end of said second reciprocating drive means to said edge protector positioning apparatus comprises a gimbal mounting.

10. Apparatus of claim 9 in which said first and second reciprocating drive means each comprise a fluid motor.

11. Edge protector positioning apparatus of claim 1 in combination with a compression strapping machine having a reciprocably movable pressure platen to compress said package prior applying said edge protector to said edge and a means for applying and securing a strap about a package and over said edge protector, said edge protector positioning apparatus being supported by and movable with said platen.

12. Edge protector positioning apparatus of claim 10 in combination with a compression strapping machine having a reciprocably movable pressure platen to compress said package prior applying said edge protector and a means for applying and securing a strap about a package and over said edge protector, said edge protector positioning apparatus being supported by and movable with said platen.

13. Edge protector positioning apparatus of claim 1 in combination with a strapping machine having means for applying and securing a strap about said package and over said edge protector.

14. Edge protector positioning apparatus of claim 10 in combination with a strapping machine having means for applying and securing a strap about said package and over said edge protector.

* * * * *